US005217061A

United States Patent [19]

Yamauchi et al.

[11] Patent Number: 5,217,061

[45] Date of Patent: Jun. 8, 1993

[54] TWIN ROLL CONTINUOUS CASTING OF METAL STRIP

[75] Inventors: Takashi Yamauchi; Morihiro Hasegawa, both of Yamaguchi, Japan

[73] Assignee: Nisshin Steel Co., Ltd., Japan

[21] Appl. No.: 896,889

[22] Filed: Jun. 10, 1992

Related U.S. Application Data

[63] Continuation of Ser. No. 684,505, Apr. 15, 1991, abandoned, which is a continuation of Ser. No. 410,590, Sep. 21, 1989, abandoned.

[30] Foreign Application Priority Data

Sep. 30, 1988 [JP] Japan ..... 63-243994

[51] Int. Cl.[5] ..... B22D 11/06

[52] U.S. Cl. ..... 164/480; 164/428

[58] Field of Search ..... 164/428, 480

[56] References Cited

U.S. PATENT DOCUMENTS 2,128,941 9/1938 Hudson ..... 164/428
4,784,208 11/1988 Fukase et al. ..... 164/428

FOREIGN PATENT DOCUMENTS 58-68460 4/1983 Japan ..... 164/480
58-188543 11/1983 Japan ..... 164/428
59-193742 11/1984 Japan ..... 164/428
60-21159 2/1985 Japan ..... 164/428
60-30555 2/1985 Japan ..... 164/428
63-80945 4/1988 Japan ..... 164/428

*Primary Examiner*—J. Reed Batten, Jr.
*Attorney, Agent, or Firm*—Lowe, Price, LeBlanc & Becker

[57] ABSTRACT

A metal strip is continuously cast through a gap of a pair of internally cooled rolls rotating in the opposite direction to each other having a pair of side dams disposed on both sides of the rolls and a pair of longitudinal dams disposed with their bottom surfaces held slightly above the roll surfaces so that openings are formed between the bottom surfaces of the longitudinal dams and the roll surfaces and that during steady state operation of the apparatus the openings are positioned at a level of the surface of molten metal in the pool. The longitudinal dams are capable of preventing formation of triple point solidified shells and make it possible that the surface of molten metal may come in contact with the surfaces of the rolls while forming the transversely uniform contacting edges, and therefore, the apparatus produces metal strips having enhanced surface quality which are substantially free from molten metal wrinkles. The advantages are further promoted by using a pouring device having a slit-shaped nozzle.

2 Claims, 4 Drawing Sheets

TWIN ROLL CONTINUOUS CASTING OF METAL STRIP

This application is a continuation of application Ser. No. 07/684,505 filed Apr. 15, 1991 which in turn is a continuation of application Ser. No. 07/410,590 filed Sep. 21, 1989, both now abandoned.

TECHNICAL FIELD OF THE INVENTION

The present invention relates to an improvement in a twin roll continuous casting apparatus for continuously casting a metal strip directly from a molten metal such as a molten steel.

BACKGROUND OF THE INVENTION

Well known in the art is a so-called twin roll continuous casting apparatus in which a pair of internally cooled rolls having respectively horizontal axes and rotating in opposite direction to each other are disposed parallel to each other with an appropriate gap therebetween, a pool of molten metal is formed on the circumferential surfaces (the upper halves cylindrical surfaces in the axial directions) of the rolls above the gap and the molten metal is continuously cast into a metal strip through the gap while being cooled by the circumferential surfaces of the rotating rolls. There has also been proposed such a twin roll continuous apparatus applied to a case of continuous casting of steel to produce a steel strip directly from molten steel.

When a metal strip is continuously cast through a gap between a pair of rolls, it is necessary to form a pool of molten metal on the circumferential surfaces of the pair of rolls above the gap therebetween and to maintain a level of the molten metal in the pool substantially constant by continuously pouring the molten metal into the pool. In order to form the pool of molten metal, there are required a pair of dams having their surfaces perpendicular to the roll axes which prevent an overflow of molten metal along the roll axes on the circumferential surfaces of the rolls. These dams also serve usually to regulate the width of the cast strip and are referred to herein as "side dams". In addition to the side dams disposed at the left and right sides of the rolls, a pair of front and rear dams (referred to herein as "longitudinal dams") having their surfaces along the roll axes may be erected orthogonally to the side dams on the circumferential surfaces of the rolls so as to form a box-like pool for molten metal with the side dams and the longitudinal dams. The box-like pool serves to prevent waves of molten metal in the pool from directly hitting the surfaces of the rolls, thereby preventing formation of wrinkles (called "molten metal wrinkles") on the surfaces of the cast strip.

If the longitudinal dams are erected on the surfaces of the rolls so as to intercept the molten metal in the pool by inside surfaces of the dams, as shown in FIG. 4, the molten metal stagnates at those corners of the pool, which are formed by the inside walls of the longitudinal dams and the surfaces of the rolls, where it is liable to be solidified forming so-called triple point shells on lower edges of the longitudinal dams, since it is cooled by both the longitudinal dams and rolls. When the triple point shells grow to a certain size, they drop from the longitudinal dams and are incorporated in surfaces of the strip being cast, causing defects of the product.

OBJECT OF THE INVENTION

An object of the invention is to provide an improved twin roll continuous casting apparatus having a pair of longitudinal dams, which is capable of preventing formation of triple point shells and avoiding adverse affects of waves of molten metal, thereby ensuring a stable production of a strip of good quality.

SUMMARY OF THE INVENTION

An apparatus for continuously casting a metal strip according to the invention comprises a pair of internally cooled rolls rotating in the opposite direction to each other and disposed parallel to each other with their axes held horizontal, and pairs of side dams and longitudinal dams for forming a pool of molten metal on the circumferential surfaces of the pair of rolls, said pair of side dams being disposed opposite to each other in a direction perpendicular to the roll axes with a space therebetween approximately corresponding to the width of a metal strip to be cast, said pair of longitudinal dams being disposed opposite to each other in a direction parallel to the roll axes, thereby continuously casting molten metal in the pool into a metal strip through a gap between the pair of rolls, wherein said pair of longitudinal dams are disposed with their bottom surfaces held slightly above the roll surfaces so that openings are formed between the bottom surfaces of the longitudinal dams and the roll surfaces and that during steady state operation of the apparatus the openings are positioned at a level of the surface of molten metal in the pool.

Preferably, the apparatus according to the invention further comprises a pouring device having slit-shaped nozzle on the bottom for supplying molten metal through the slit to the pool which is disposed above the pool so that the slit is positioned above the surface of molten metal in the pool and extends parallel to the gap of rolls.

Brief Description of the Drawings

Preferred embodiments of the invention will now be described with reference to the attached drawings in which.

Detailed Description of Preferred Embodiment(s)

Figure 1:
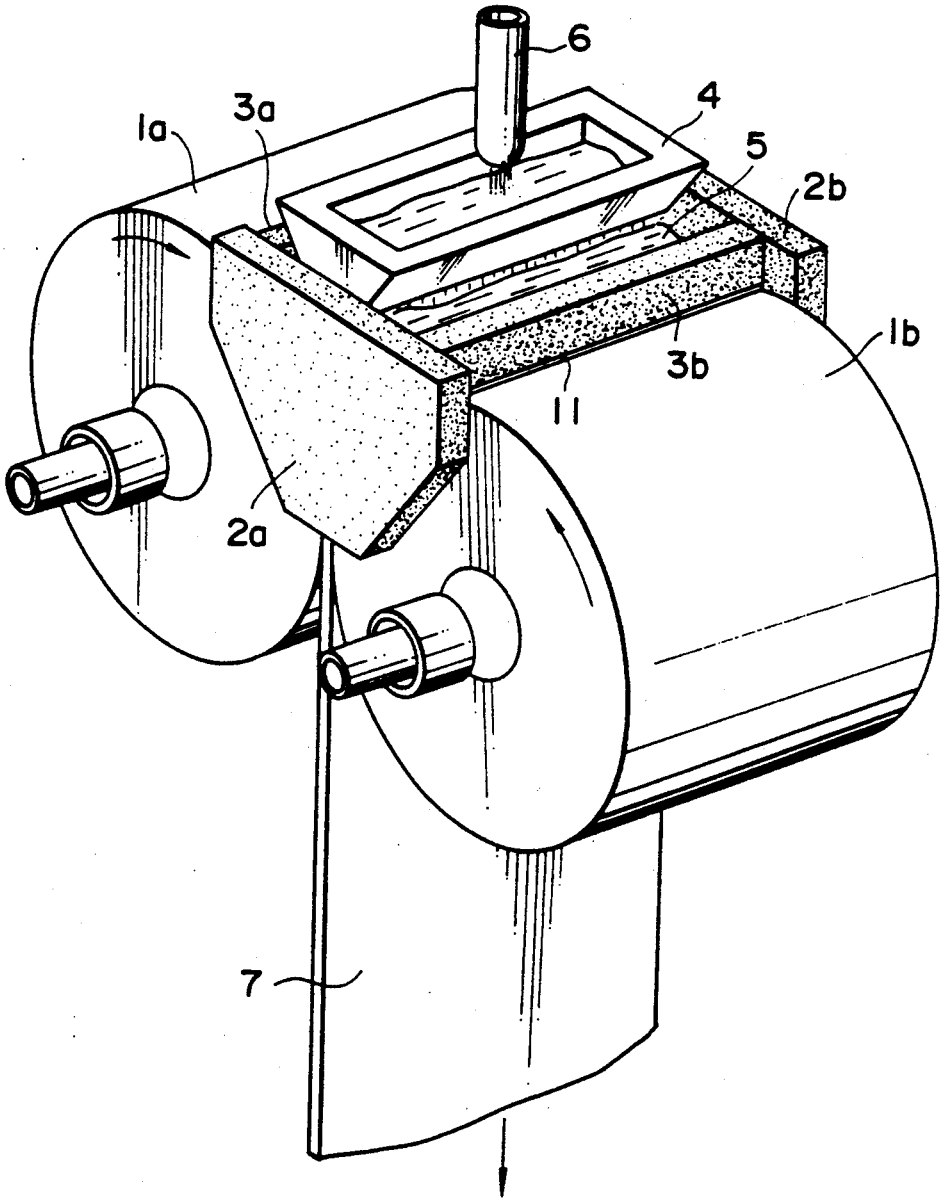
FIG. 1 is a perspective view showing principal portions of an embodiment of the apparatus according to the invention.

Referring to FIG. 1, reference numerals 1*a*, 1*b* designate a pair of internally cooled rolls rotating in the opposite direction to each other (the rotational directions of both rolls are shown by arrow) rows) and opposed parallel to each other with their roll axes held horizontal. Reference numerals 2*a*, 2*b* designate side dams slidably contacting respective side surfaces of the rolls, and 3*a*, 3*b* longitudinal dams disposed in parallel to the roll axes and perpendicularly to the side dams. The bottom surfaces of the longitudinal dams and the surfaces of the rolls are substantially parallel to each other respectively with respective openings between them as described hereinafter in detail. The respective longitudinal dams and the respective side dams contact each other so that leakage of molten metal be prevented. The side dams may be of a type as disclosed in JP A 62-84,555 corresponding to U.S. Pat. No. 4,811,780, in which side dams are forcibly moved downwards while being abrasively worn by the rolls. FIG. 1 depicts an example of the apparatus according to the invention, which is provided with a pouring device 4 for supplying molten metal to the pool defined by the longitudinal and side dams and the surfaces of the rolls. Reference numeral 5 designates a surface level of molten metal in the pool, 6 a parent nozzle for supplying molten metal to the pouring device, and 7 a strip being cast.

Figure 2:
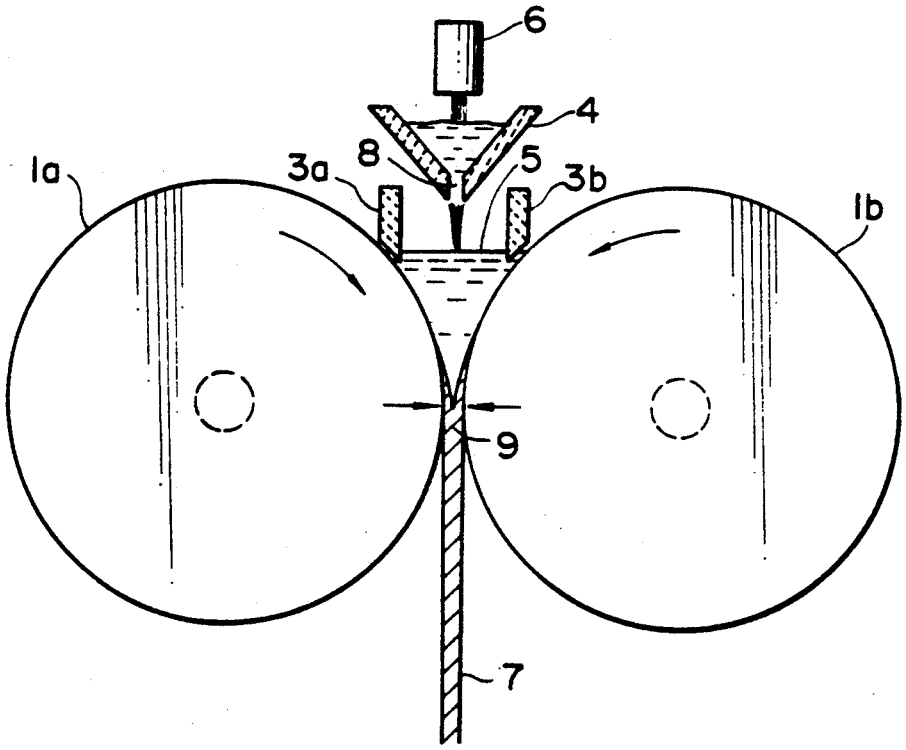
FIG. 2 is a cross-sectional view of the apparatus of FIG. 1 taken along a plane perpendicular to the roll axes at the center of the rolls.

FIG. 2 is a cross-sectional view of the apparatus of FIG. 1 taken along a plane perpendicular to the roll axes at the center of the rolls, showing the state of casting. As shown in FIGS. 1 and 2, the pouring device is an intermediate vessel having slit-shaped nozzle 8 on the bottom for supplying molten metal through the slit 8 to the pool, and is disposed above the pool so that the slit 8 is positioned above the surface 5 of molten metal in the pool and extends parallel to the gap of rolls. Namely, the pouring device is located in position so that the direction in which the slit 8 extends is substantially in a plane which contains the narrowest gap 9 of the rolls 1*a*, 1*b* and is perpendicular to the surface 5 of molten metal. The length of the slit 8 is preferably as close as possible to the length of the longitudinal dams (the distance between the side dams). During steady state operation of the apparatus, molten metal is continuously supplied through the parent nozzle 6 to the pouring device 4 at an appropriate rate to form a film flow of molten metal parallel to the inside surfaces of the longitudinal dams 3*a*, 3*b*, which falls through the slit 8 of the pouring device 4 in the pool at the central portion of the longitudinal dams (the position corresponding to the narrowest gap between the rolls 1*a*, 1*b*), thereby producing the strip 7 while maintaining the surface 5 of molten metal in the pool at a predetermined level.

Figure 3:
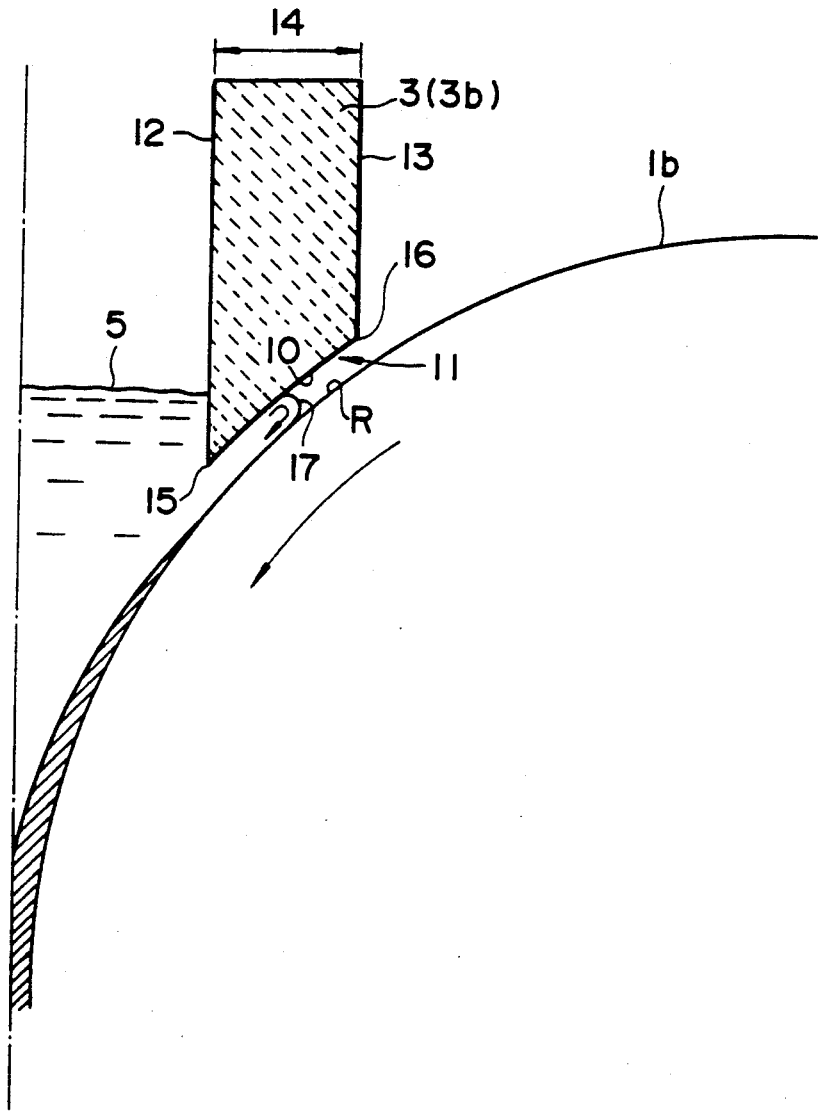
FIG. 3 is an enlarged cross-sectional partial view of the apparatus of FIG. 1 similar to FIG. 2 showing the opening between the longitudinal dam and the surface of the roll.

FIG. 3 is an enlarged cross-sectional partial view of the longitudinal dam 3*b* and the surface of the roll 1*b* during steady state operation of the apparatus. The same conditions symmetrically appear on the side of the longitudinal dam 3*a*. As shown in FIG. 3, the longitudinal dam 3 is disposed with the bottom surface 10 held slightly above the roll surface R so that an opening 11 is formed between the bottom surface 10 of the longitudinal dam 3 and the roll surface R and that during steady state operation of the apparatus the opening 11 is positioned at a level of the surface 5 of molten metal in the pool. More particularly, whereas the longitudinal dam 3 has an inside surface 12, an outside surface 13 and a predetermined thickness 14 therebetween, the bottom surface 10 within the range of the thickness 14 is formed a flat, preferably curved, surface corresponding the circumferential surface of the roll, and the longitudinal dam 3 is disposed so that the level of the surface 5 of molten metal is positioned during steady state operation of the apparatus between a level of an inside lower edge 15, defined by the inside surface 12 and the bottom surface 10, and a level of an outside lower edge 16, defined by the outside surface 13 and the bottom surface 10. In other words, the apparatus is operated under such conditions that the surface 5 of molten metal in the pool is always positioned in the opening 11.

Thus, the longitudinal dam 3 is partly dipped in the pool with its inside lower edge 15 immersed in molten metal and stop waves on the surface of molten metal with its inside surface 12. The outside lower edge 16 does not contact the molten metal entering the opening 11. If the clearance of the opening 11 is suitable, the molten metal in the opening 11 stationary forms a narrow round surface 17 which is uniform in the transverse direction (of the strip being cast) owing to a surface tension of the molten metal and the rotation of the roll 1. To the contrary, if the molten metal passes through the opening 11 and goes beyond the outer lower edge 16 to reach the roll surface outside the longitudinal dam 3, the edge on the molten metal does not become linear in the transverse direction, that is, the surface of molten metal comes in contact with the circumferential surface R of the roll forming an irregular intersection line, which is a cause of occurrence of molten metal wrinkles on the surface of the cast strip. It has been found that the clearance of the opening 11 should preferably be from about 2 to 10 mm. If the clearance of the opening 11 is too small, the molten metal does not effectively enter the opening 11, and thus, the advantageous results of the invention cannot be enjoyed. On the other hand, with an opening of an unduly large clearance, a desirably round narrow surface 17 of molten metal is not formed in the opening, that is, the surface of molten metal in the opening becomes irregular and runs in waves. The above-mentioned clearance of from about 2 to 10 mm has been experimentally found suitable.

Figure 4:
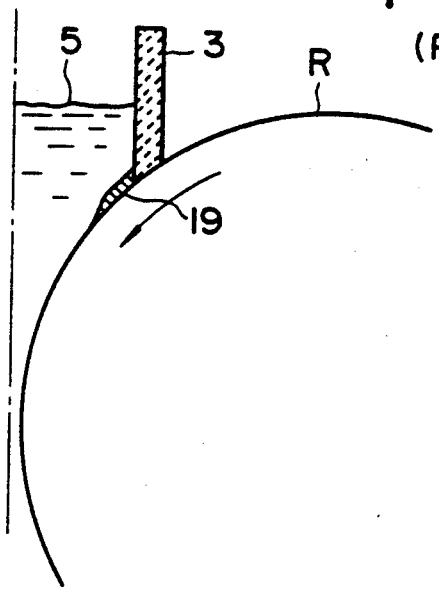
FIG. 4 (PRIOR ART)
FIG. 4 is a cross-sectional view similar to FIG. 3 showing an example outside the scope of the invention.
Figure 5:
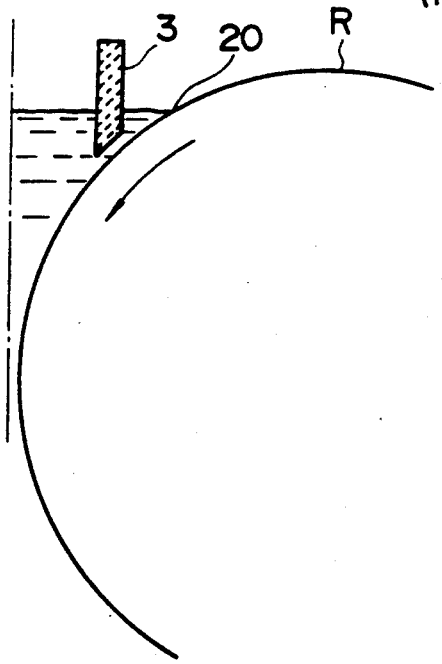
FIG. 5 (PRIOR ART)
FIG. 5 is a cross-sectional view similar to FIG. 4 showing another example outside the scope of the invention.

FIGS. 4 and 5 show examples outside the scope of the invention. In the example shown in FIG. 4, the longitudinal dam 3 is erected on the circumferential surface R of the roll with the bottom surface of the dam slidably contacting the surface R, and the surface 5 of molten metal is positioned substantially above the above-mentioned slidable contact surface. In that case, at that corner of the pool, which is formed by the inside wall of the longitudinal dam 3 and the surface R of the roll, molten metal is liable to be solidified forming a so-called triple point shell 19 on the inside lower edge of the longitudinal dam, since it is cooled by both the longitudinal dam and roll. When the triple point shell grows to a certain size, it drops from the longitudinal dam and passes through the gap of rolls together with sound shells, causing defects of the product. According to the invention, formation of such a triple point shell is prevented. In the example shown in FIG. 5, the longitudinal dam 3 is disposed with a considerably large opening between its bottom surface and the roll surface, and so that the whole bottom surface of the dam 3 is submerged in the molten metal. In this example, the casting is carried out under such conditions that the surface of molten metal goes beyond the outer lower edge 16 and reaches the circumferential surface of the roll outside the longitudinal dam 3. In that case, the edge 20 of the surface of molten metal coming in contact with the circumferential surface of the roll does not become linear in the transverse direction of the strip (in the direction perpendicular to the plane of the figure) and looks something like side waves hitting something. As a result, surface defects (molten metal wrinkles) appear on the surfaces of solidified shells formed on the circumferential surface of the roll, and thus, on the surfaces of the cast strip. According to the invention, occurrence of such surface defects can be prevented, since a round edge 17 of the surface of molten metal, which is linear in the transverse direction of the strip, is formed in the opening 11 by the surface tension of molten metal.

Waves beating upon the inside surface 12 of the longitudinal dam 3 may be further minimized by providing the pouring device equipped with the slit-shaped nozzle 8 on the bottom in the manner as shown in FIGS. 1 and 2, thereby eliminating or further reducing any surface defects caused by waving of the surface of molten metal in the pool.

As described above, it is outside the scope of the invention to use the longitudinal dam in the manner as shown in FIGS. 4 or 5. The purpose of the invention is not achieved unless that position of the surface of molten metal which contact the roll surface is retained within the opening 11 formed between the bottom surface of the longitudinal dam and the roll surface. The level of the surface 5 of molten metal in the pool is substantially the same as or slightly higher than the level of the round surface 17 of molten metal in the opening 11. An excessively high level of the surface 5 of molten metal in the pool should be avoided. It should also be avoided to immerse the longitudinal dam 3 so deeply that the molten metal may go beyond the longitudinal dam 3. In the apparatus according to the invention, the surface 17 of molten metal in the opening 11 is vigorously renewed by the rotation of the roll and the viscosity of the molten metal; no triple point corners where molten metal tends to stagnate are formed in the pool; and cooling of molten metal in the vicinity of the inside lower edge 15 is reduced, since the longitudinal dam 3 is not cooled by the roll, and therefore, formation of the triple point solidified shells 19, as shown in FIG. 4, can be effectively prevented.

The longitudinal dams partly dam up a surface flow of molten metal in the pool, and pose a problem in that a solidified skin is likely formed on the surface of molten metal in the pool. This problem is, however, effectively overcome by using the pouring device 4 equipped with the slit-shaped nozzle 8 on the bottom, thereby continuously supplying super heated molten metal over the whole width of the surface of molten metal in the pool. Furthermore, the film flow of molten metal supplied by the pouring device 4 is uniform widthwise, thereby reducing localized rises of molten metal in the pool, and in turn further enhancing the widthwise uniformity of the surface 17 of molten metal in the opening 11.

Accordingly, the longitudinal dams in the apparatus according to the invention, in which the pouring device 4 having the slit-shaped nozzle 8 is provided, do not suffer from the problem, generally inherent in longitudinal dams, of formation of the solidified skin on the surface of molten metal in the pool, and are productive of the above-mentioned desirable results. In order that the slit is not clogged and capable of continuously supplying a film flow of molten metal sufficiently extending widthwise, it has been found that a suitable opening of the slit 8 is within the range of from about 2 to 7 mm.

While the invention has been illustrated with respect to fixed side dams, it should be appreciated that the invention can be applied to movable side dams as well as to abradable side dams erected on the surfaces of the rolls so that at least a part of the width of each dam slidably contact the surface of each roll. Entities of the respective longitudinal dams and pouring device are made of adiabastic refractory materials.

As described hereinabove, the apparatus according to the invention makes it possible that the surface of molten metal may come in contact with the surfaces of the rolls while forming the transversely uniform contacting edges, by means of the prescribed longitudinal dams capable of preventing formation of triple point solidified shells, and therefore, the apparatus according to the invention is productive of metal strips having enhanced surface quality which are substantially free from molten metal wrinkles. These advantages of the apparatus according to the invention are further promoted by using the herein described pouring device having the slit-shaped nozzle.

I claim:

1. A method for continuously casting a metal strip comprising the steps of: providing a pair of internally cooled rolls rotatable in an opposite direction to each other and disposed parallel to each other with their axes held horizontal, and pairs of imperforated side dams and imperforated longitudinal dams for forming and maintaining a pool of molten metal at a predetermined height on circumferential surfaces of the pair of rolls, disposing said pair of side dams opposite to each other in a direction perpendicular to the roll axes with a space therebetween approximately corresponding to the width of a metal strip to be cast, disposing said pair of longitudinal dams opposite to each other in a direction parallel to the roll axes, rotating said internally cooled rolls, continuously pouring molten metal in the pool to form and maintain said pool at a predetermined height on the circumferential surfaces of the pair of internally cooled rolls; casting said molten metal in the pool through a gap located between the pair of rolls into a metal strip, while disposing said pair of longitudinal dams with their bottom surfaces held slightly above the roll surfaces to form openings defining a clearance of from about 2 to 10 mm between the bottom surfaces of the longitudinal dams and the roll surfaces, said openings being spaced along the circumferential surfaces of said pair of rolls for forming said pool so that molten metal from said pool extends into each said opening during said pouring step and forming and maintaining a height of the molten metal in said opening at a height corresponding substantially to said predetermined height of said pool.

2. A method for continuously casting a metal strip comprising the steps of: providing a pair of internally cooled rolls rotatable in an opposite direction to each other and disposed parallel to each other with their axes held horizontal, and pairs of imperforated side dams and imperforated longitudinal dams for forming and maintaining a pool of molten metal at a predetermined height on circumferential surfaces of the pair of rolls, disposing said pair of side dams opposite to each other in a direction perpendicular to the roll axes with space therebetween approximately corresponding to the width of a metal strip to be cast, disposing said pair of longitudinal dams opposite to each other in a direction parallel to the roll axes, rotating said internally cooled rolls, continuously pouring molten metal in the pool to form and maintain said pool at a predetermined height on the circumferential surfaces of the pair of internally cooled rolls; casting said molten metal in the pool through a gap located between the pair of rolls into a metal strip, while disposing said pair of longitudinal dams with their bottom surfaces held slightly above the roll surfaces to form openings defining a clearance of from about 2 to 10 mm between the bottom surfaces of the longitudinal dams and the roll surfaces, said openings being spaced along the circumferential surfaces of said pair of rolls for forming said pool so that molten metal from said pool extends into each said opening during said pouring step and forming and maintaining a height of the molten metal in said opening at a height substantially corresponding to said predetermined height of said pool, wherein said method further comprises providing a pouring device having a slit on the bottom thereof for supplying molten metal through said slit to the pool, and positioning the pouring device above the pool so that said slit is positioned above the surface of molten metal in the pool and extends parallel to said gap between said rolls.

* * * * *